US005775582A

United States Patent [19]

Hammer

[11] Patent Number: 5,775,582

[45] Date of Patent: Jul. 7, 1998

[54] METHOD AND APPARATUS FOR REGULATING HEATER CYCLES TO IMPROVE FUEL EFFICIENCY

[76] Inventor: Jack Hammer, 2973 Brentwood Ct., Wantagh, N.Y. 11793

[21] Appl. No.: 811,867

[22] Filed: Mar. 5, 1997

Related U.S. Application Data

[60] Provisional application No. 60/031,771 Nov. 25, 1996, and provisional application No. 60/027,444 Sep. 26, 1996.

[51] Int. Cl.[6] ..... G05S 23/00; G05S 23/24

[52] U.S. Cl. ..... 237/8 A; 236/91 F; 122/446; 122/447

[58] Field of Search ..... 236/9 A, 9 R, 236/91 F; 237/8 A; 122/446, 447

[56] References Cited

U.S. PATENT DOCUMENTS

| | | | |
|---|---|---|---|
| 2,181,480 | 11/1939 | Gillett et al. | 236/91 |
| 2,266,245 | 12/1941 | Osterheld | 219/39 |
| 2,266,253 | 12/1941 | Osterheld | 219/39 |
| 2,477,728 | 8/1949 | Gerald | 236/46 |
| 2,504,491 | 4/1950 | Broderick | 237/8 |
| 2,626,755 | 1/1953 | Tidd | 237/8 |
| 3,408,004 | 10/1968 | Miller | 236/9 |
| 3,576,177 | 4/1971 | Black et al. | 122/1 |
| 3,979,059 | 9/1976 | Davis | 236/46 |
| 3,979,710 | 9/1976 | Jespersen | 338/91 |
| 3,995,810 | 12/1976 | Banks | 237/8 |
| 4,108,375 | 8/1978 | Keeney | 237/8 |
| 4,292,813 | 10/1981 | Paddock | 62/158 |
| 4,381,075 | 4/1983 | Cargill et al. | 237/8 |
| 4,433,810 | 2/1984 | Gottlieb | 236/91 F X |
| 4,470,541 | 9/1984 | Raleigh | 236/21 |
| 4,502,625 | 3/1985 | Mueller | 236/11 |
| 4,516,720 | 5/1985 | Chaplin | 236/91 F X |
| 4,522,333 | 6/1985 | Blau, Jr. et al. | 236/20 |
| 4,585,165 | 4/1986 | Iverson | 236/91 F X |
| 4,634,046 | 1/1987 | Tanaka | 236/46 |
| 4,637,349 | 1/1987 | Robinson | 122/448 |
| 4,685,616 | 8/1987 | Stein | 236/91 F X |
| 4,844,335 | 7/1989 | McKinley et al. | 236/91 F X |
| 4,850,310 | 7/1989 | Wildgen | 122/446 |
| 5,125,572 | 6/1992 | Piegari | 237/8 |
| 5,190,215 | 3/1993 | Habermehl, Jr. et al. | 236/91 |
| 5,192,020 | 3/1993 | Shah | 236/46 |
| 5,219,119 | 6/1993 | Kasper | 236/46 |
| 5,326,026 | 7/1994 | Jefferson et al. | 236/11 |
| 5,337,955 | 8/1994 | Burd | 236/91 F |
| 5,470,019 | 11/1995 | Martensson | 237/19 |

*Primary Examiner*—Christopher Kilner
*Attorney, Agent, or Firm*—Nolte, Nolte and Hunter, P.C.

[57] ABSTRACT

A method and apparatus for improving heating system efficiency. An electronic circuit senses a firing signal from a boiler energy value sensor such as a thermostat or pressuretrol. The circuit prevents the boiler energy value sensor from firing the burner, while the circuit senses an energy value of the outflow line at the boiler. The circuit monitors the outflow energy value and records the outflow energy value at a first time of the firing signal. The circuit then continually monitors the outflow energy until it detects an energy drop from the initial outflow energy value. The circuit responds to the energy drop by firing the burner. The invention self adaptively responds to present thermal load, reduces the number of on-off cycles, increases each burner run time while reducing total run time, improves fuel consumption, and reduces air pollution.

24 Claims, 4 Drawing Sheets

4
HOT
19D
50
52
22
18
20
24
28
27
34
39
30
8
19C
26
38
19B
14
10
2
16
$H_2O$
19A
6

METHOD AND APPARATUS FOR REGULATING HEATER CYCLES TO IMPROVE FUEL EFFICIENCY

This application claims the benefit of U.S. Provisional Application No. 60/027,444, filed Sep. 26, 1996, and U.S. Provisional Application No. 60/031,771, filed Nov. 25, 1996.

FIELD OF INVENTION

The present invention relates to a method and apparatus for improving heating system efficiency, particularly in heating systems which utilize a boiler to heat a fluid such as water or steam for transfer of heat via a heat exchanger to a space to be heated.

BACKGROUND OF INVENTION

Heating systems utilizing burners and boilers are at their least efficient when starting up. Prior to achieving operating temperature, the burner burns less cleanly. Heating systems generally operate at their peak efficiency when they are fully loaded. But heating systems generally are sized for the area to be heated in such a fashion that the only time the boiler is properly matched to the heating load is when the outside temperature is the value for which the system was designed for. A system is usually sized for the worst case temperature conditions as expected in a given geographic area. The net effect of this is that whenever the outside temperature exceeds this design temperature, the boiler is oversized for the heating load and is thus less efficient. Evidence of this is the cycling on and off of the burner which heats the boiler.

Boilers have, as part of their inherent design, a heating media which is transferred throughout the heating load as a means of transferring the heat and subsequently heating the area. This heating media has a mass which retains heat even after the boiler shuts down. Various schemes have been used to take advantage of this thermal inertia to prolong off times and run times under certain load conditions.

U.S. Pat. No. 2,266,245, issued Dec. 16, 1941 to Osterheld for an OFF-PEAK WATER HEATING SYSTEM. It refers to:

"time and water temperature controlled means to cause energization of the heater at the start of the off-peak period in case less than a predetermined fractional part of the water content of a tank is hot at the start of an off-peak period, to delay energization of the heater for an adjustably predetermined length of time after start of an off-peak period in case said predetermined fractional part of the water content is hot at the start of an off-peak period . . . ."

U.S. Pat. No. 4,108,375 issued Aug. 22, 1978 to Keeney for a CONTROL DEVICE AND PROCESS FOR HEATING AN INSTALLATION and refers to comparing "the heating medium temperature and the temperature outside the installation" and lowering the "heating medium to the lowest temperature required . . . ."

U.S. Pat. No. 4,381,075 issued Apr. 26, 1983 to Cargill et al. And refers to a MICROPROCESSOR BASED CONTROLLER FOR HEATING SYSTEM for:

"Modulating heat exchanger temperature as a function of outdoor temperature . . . and, . . . providing an override period for domestic hot water production . . . ."

U.S. Pat. No. 4,637,349 issued Jan. 20, 1987 to Robinson for a BOILER CYCLING CONTROLLER which refers to "reducing the tendency to cycle" by reducing boiler flow temperature "as the outside temperature rises". There is a sensor:

"to override the control system and switch-on the boilers to ensure that the temperature at which return water enters the boilers does not drop below a predetermined value . . . ."

U.S. Pat. No. 4,850,310 issued Jan. 20 1987 to Wildgen for a BOILER CONTROL HAVING REDUCED NUMBER OF BOILER SEQUENCES FOR A GIVEN LOAD and purports:

"To reduce the number of boiler sequences over time . . . the call signal applied to the boiler to initiate a sequence in response to a demand for heating is delayed as a function of outside temperature and time elapsed since the end of the previous heating cycle."

U.S. Pat. No. 5,470,019 issued Nov. 28, 1995 to Martensson for a DEVICE FOR CONTROLLING HEATING BOILERS which purports to "measure the time between exceeding of the second temperature level and underpassing of the first level" and "to delay the start of the heating means . . . " on the next cycle, after a boiler thermostat call, for a time interval which is a function of the measured time. The patent refers also to detecting tap water temperature and stopping the delay below a predetermined tap water temperature.

OBJECTS OF THE INVENTION

The present invention seeks to reduce the number of cycles without measuring ambient temperatures or measuring or relying on past off times to calculate delays.

It is an object of the present invention to measure present load and prevent burner firing until the present load justifies firing the burner. It is an object to utilize the thermal mass of the heating media, which retains heat even after the boiler shuts down. The utilization of this retained heat in conjunction with more efficient burn cycles by the invention cause the fuel savings of the present invention.

BRIEF DESCRIPTION OF THE INVENTION

The invention is a microprocessor controlled device which, when properly connected to a gas or oil fueled hot water or steam boiler will render the effect of more fuel efficiency (because of less total burner on time) which correlates directly to fuel, energy and money savings. An added side benefit of the invention is the reduced electrical usage as well as reduced maintenance costs due to fewer burn cycles and less total "on" time of the boiler's burner, and reduced air pollution.

Experimentation has shown that by extending the "off" time of the burner even after called to start will result in a longer "on" time per "on" cycle but the total number of "on" cycles is reduced. By example if a burner was cycling "off" for 60 minutes and then "on" for 12 minutes this would result in a total number of "runs" of 10 and a total "on" time of 120 minutes in a 12 hour period. If we then employed the invention device, the "off" cycle time might change to 80 minutes with an "on" time of 14 minutes. This when extended out to a 12 hour period would yield a total number of run cycles of 7.7 with a total "on" time of 107.8 minutes.

This is an 11.2% reduction in actual fuel and electrical consumption associated with the burner and also a 23% reduction in the number of burner "on" cycles.

For Hot Water Boiler applications the invention intercepts and interrupts the signal sent by the boiler's built-in thermostat, which activates the burner. For safety reasons the boiler's built-in thermostat is never overridden by the invention, it is simply interrupted. The boiler thermostat is still responsible for the maximum temperature setting of the boiler. The invention determines the optimum instance of allowing the electrical path to be completed and subsequent starting of the boiler's burner, by taking a temperature reading (by invention sensors located as close as possible to the discharge of the boiler and/or domestic hot water heating coil) at the instant of a "call for heat" by the boiler thermostat, and storing these readings in the invention. These stored readings are compared to those of subsequent temperature readings via the same sensor(s). When the desired amount of difference (user adjustable) between either of the temperature readings, as compared to its corresponding stored value, is surpassed the electrical circuit will be completed. The temperature sensors also perform the task of monitoring the heating media temperature and or domestic water temperatures and will allow the burner to fire regardless of the "temperature differential" determination by completing the burner circuit when a user adjustable absolute minimum value is reached. For system flexibility the temperature sensor(s) may be replaced or run in parallel with a pressure dependent switch or thermostat or any other means by which the sensor signal leads are electrically shorted when the desired minimum temperature is reached. The number of sensors is determined by the particular installation and depends on the application. (i.e. heating only, heating and domestic hot water generation, or domestic hot water generation only.)

For Steam Boiler applications the invention intercepts and interrupts the signal sent by the boiler's built-in pressuretroll and/or domestic hot water thermostat which activates the burner. For safety reasons the boiler's built-in pressuretroll/thermostat is never overridden by the invention, it is simply interrupted. The boiler pressuretroll is still responsible for the maximum pressure setting of the boiler and domestic hot water thermostat the maximum water temperature. The invention determines the optimum instance of allowing the electrical path to be completed and subsequent starting of the boiler's burner, by taking a pressure/temperature reading (by invention sensors located as close as possible to the discharge of the boiler and/or domestic hot water heating coil) at the instant of a "call for heat" by either the boiler pressuretroll or hot water thermostat, and storing these readings in the invention. These stored readings are compared to those of subsequent pressure/temperature readings via the same sensor(s). When the desired amount of difference (user adjustable) between either of the pressure or temperature readings, as compared to its corresponding stored value, is surpassed the electrical circuit will be completed. The invention sensors also perform the task of monitoring the heating media pressure and or domestic water temperature and will allow the burner to fire regardless of the "pressure/temperature differential" determination by completing the burner circuit, when a user adjustable absolute minimum value is reached. For system flexibility the pressure/temperature sensor(s) may be replaced or run in parallel with a pressure dependent switch, thermostat, pressuretroll or any other means by which the sensor signal leads are electrically shorted when the desired minimum pressure is reached. The number of sensors is determined by the particular installation and depends on the application. (i.e. space heating only or space heating and domestic hot water.

DETAILED DESCRIPTION OF THE DRAWINGS

Figure 1:
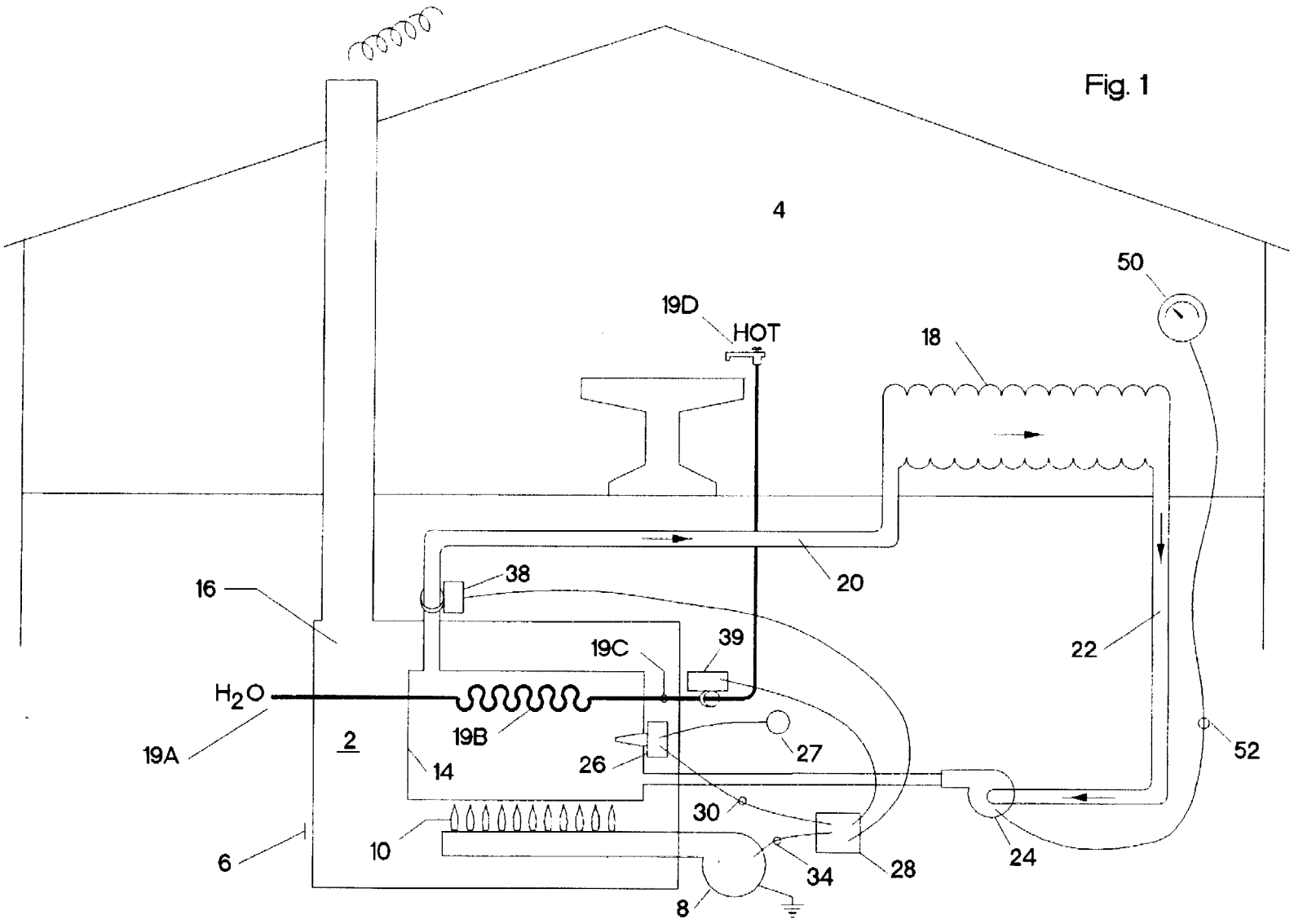
FIG. 1 is a system diagram showing the invention installed in a heating system.

As shown in FIG. 1, a heating system, generally designated 2, is designed to heat a space 4. The system includes a boiler 6. Boiler 6 is fired by burner 8 for heating the boiler. The term boiler is conventionally used, whether or not the boiler actually boils water as in steam heat, or merely heats water as in forced hot water heating.

Flame 10 from burner 8 heats the internal walls 14, or heat exchange tubes not shown, of boiler 6, which contains fluid heat transfer medium 16 such as water or steam, which delivers heat through an outflow line 17 communicating fluid heat transfer medium 16 to a heat exchanger, such as radiator 18. Heat exchanger or radiator 18 is usually located remote from the boiler in space 4. Radiator 18 transfers heat to space 4.

Domestic hot tap water is created by passing cold water from the domestic water supply 19A through coil 19B which absorbs heat from fluid heat transfer medium 16 and outflows through domestic hot water outflow pipe 19C, when demanded, as by hot water tap 19D.

In a forced hot water heating system the cooled water from radiator 18 returns via return pipe 22 and is pumped by circulator pump 24 back to boiler 6.

In a steam system the steam pressure within the boiler drives the steam through the outflow pipe 20 to radiator 18, where it re-cools to water and drains back via return pipe 22 to boiler 6. Some steam systems have no return pipe. The cooled water returns by draining back down outflow pipe 20.

Energy value sensor 26 is a thermostat in a forced hot water system or is a pressuretrol in a steam system. Energy value sensor 26 is within boiler 6 and senses a low energy, either temperature or steam pressure, at which boiler 6 requires more heat.

Conventionally the sensor 26 would switch on electrical power from power supply 27 which would supply and fire burner 8 to ignite the oil or gas and air mixture that burns and heats boiler 6 at said low energy until the sensor 26 senses a maximum energy, and terminates firing at or above the maximum energy.

In the present invention, however, a control circuit 28 is interposed between sensor 26 and burner 8 along wires 30 and 34. Control circuit 28 accomplishes the following steps:

sensing a firing signal on wire 30 from the boiler energy value sensor 26; and preventing the boiler energy value sensor 26 from firing burner 8 by interrupting the power. Control circuit 28 opens the circuit from sensor 26, switching the power to burner 8 off.

Meanwhile, on outflow pipe 20, and located at the outflow of the boiler, is means 38 for sensing an energy value of the outflow at the boiler. This outflow energy sensor means 38 should be a sensor capable of sending a signal usable by an electronic circuit. In a hot water system, the energy value is temperature. There are various usable temperature transducers such as a thermocouple, but the applicant presently prefers a thermistor mounted at the boiler outflow. By using a negative energy value coefficient thermistor, said thermistor has an inherent non-linearity, with greater voltage drops at lower temperatures, which non-linearity serves as means for a control program to respond linearly to thermistor voltage while having non-linear and increased sensitivity to smaller temperature decreases at lower temperatures.

If a linear energy sensor is used, the control program can logically induce non-linearity, making the system quicker to fire in response to lower energy drops at lower temperatures.

In a steam system, the outflow energy sensor means 38 is a pressure sensor.

Outflow energy sensor 38 senses an energy value of the outflow line 20 at boiler 6. Sensor 38's sensitivity is user adjustable by variable potentiometer 38A, and its temperature is adjustable by variable potentiometer 38B. Outflow energy sensor 39 senses an energy value of the domestic hot water outflow line 19C at boiler 6. Sensor 39's temperature is user adjustable by variable potentiometer 39A, and its sensitivity is adjustable by variable potentiometer 38A. Control circuit 28 continuously, or at frequent intervals, monitors the outflow energy values at sensors 38 and 39. Control circuit 28 records the outflow energy values at a first time of the firing signal. When either sensor 38 or 39 communicates a sufficient voltage drop below the voltage at the first time of the firing signal, to control circuit 28, circuit 28 allows the burner to fire. In installations where the boiler does not supply domestic hot water, domestic hot water outflow sensor 39 will not be provided nor be sensed or monitored by the control circuit.

Figure 4:
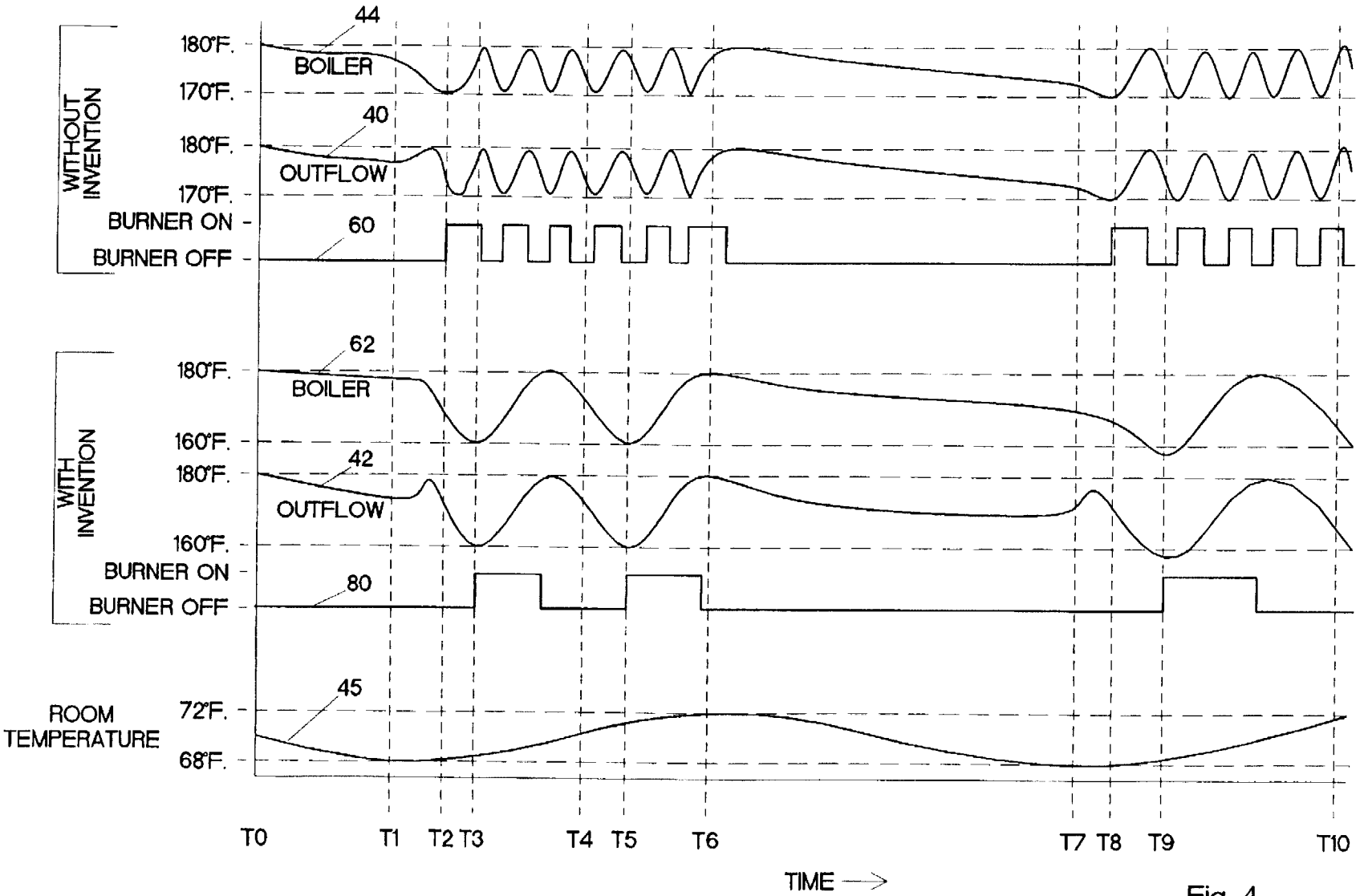
FIG. 4 is a set of graphs correlating various system temperatures, without and with the invention operating.

FIG. 4 illustrates an outflow energy value over time without using the present invention 40, and illustrates an outflow energy value over time using the present invention 42. Without the invention, boiler temperature causes, thermostat 26 (FIG. 1) to turn off burner 8 at 180° F. and turn on burner 8 at 170° F. In FIG. 4 at time T0 the boiler has just shut off and curve 44 decays slowly because the water remains still inside the boiler. At T1 room temperature 45 has fallen to a lower limit 68° F. and space thermostat 50 (FIG. 1) calls for circulator pump 24 by supplying power to it via wire 52. Cool water from heat exchanger 18 is forced by pump 24 into boiler 6. The water temperature in boiler 6 begins to drop as shown 44 between T1 and T2 in FIG. 4. At T2 the boiler thermostat detects 170° F. and fires the burner which terminates quickly at T3 when the boiler again reaches 180° F. By T6 enough hot water has been forced out of the boiler 6 (FIG. 1) by circulator pump 24 and through radiator 18 to heat space 4 to thermostat 50's upper limit, 72° F. in FIG. 4. Thermostat 50 stops the circulator pump 24 which reduces boiler load and cycling between T6 (FIG. 4) and T7. But notice how many boiler cycles 60 occur between T2 and T6. Each of these cycles has a start-up period of inefficient burning and greater air pollution.

Contrast now the performance graphs WITH INVENTION in FIG. 4. At T1 room temperature 45 causes room thermostat 50 (FIG. 1) to call for water circulation, pump 24 pumping hot water 16 from boiler 6 outflow pipe 20 past thermistor 38 which reads outflow temperature 42 (FIG. 4) as a voltage. The hot outflow causes outflow temperature 42 to rise towards boiler temperature between T1 and T2. Eventually cool water from radiator 18 (FIG. 1) reenters boiler 6 and boiler temperature 62 (FIG. 4) drops to 170° F. at T2.

Figure 2:
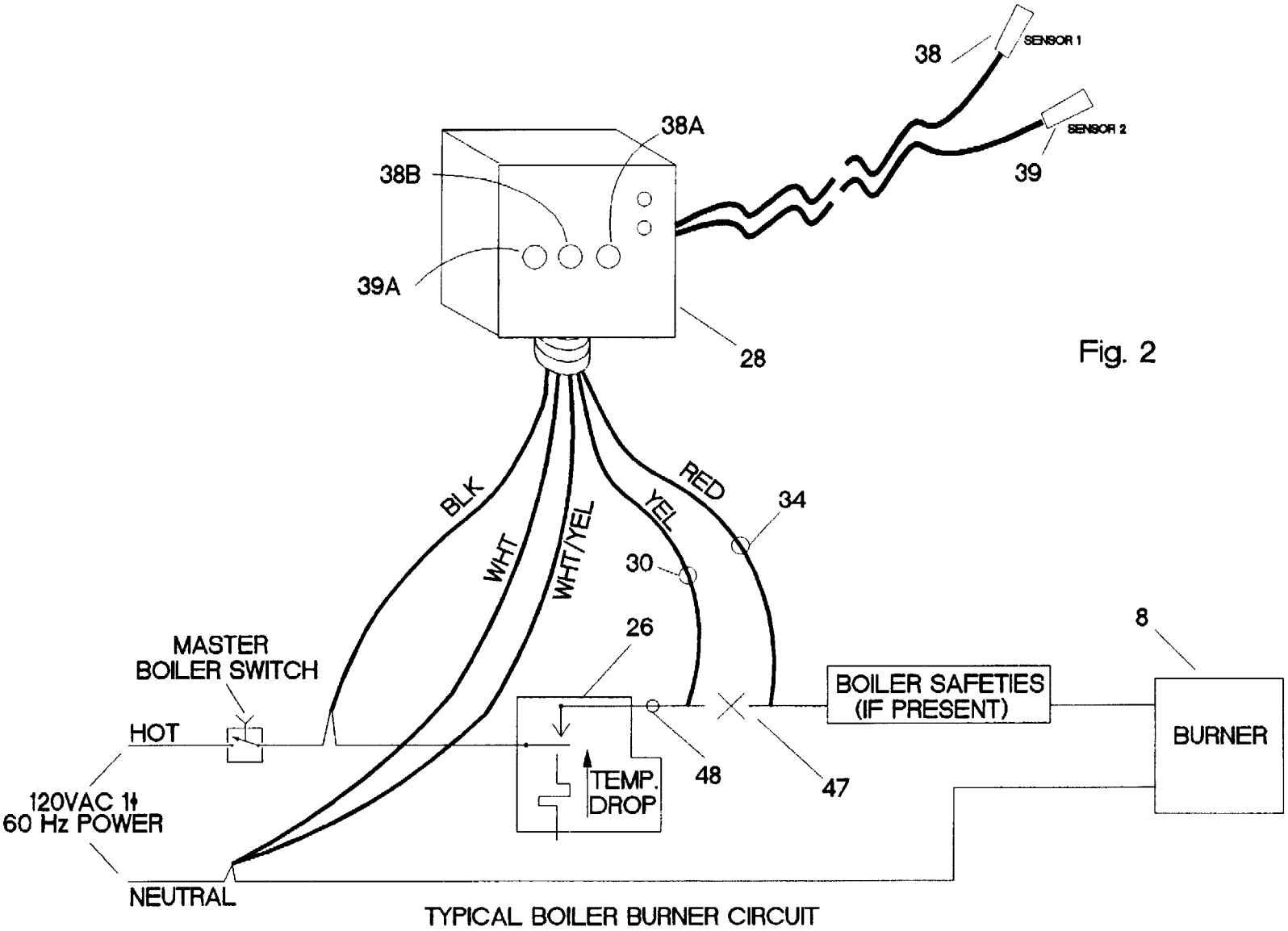
FIG. 2 is a circuit diagram showing the invention installed in a boiler burner circuit.

As shown in FIG. 2 control circuit 28 interrupts the power supply from boiler thermostat 26 to burner 8, and serves as means for preventing the boiler energy value sensor from firing the boiler, including a break 47 in a power supply wire 48 between:

energy value sensor 26 within boiler 6, and the burner 8; and means such as relay 74 for switchably bridging said break.

Figure 3:
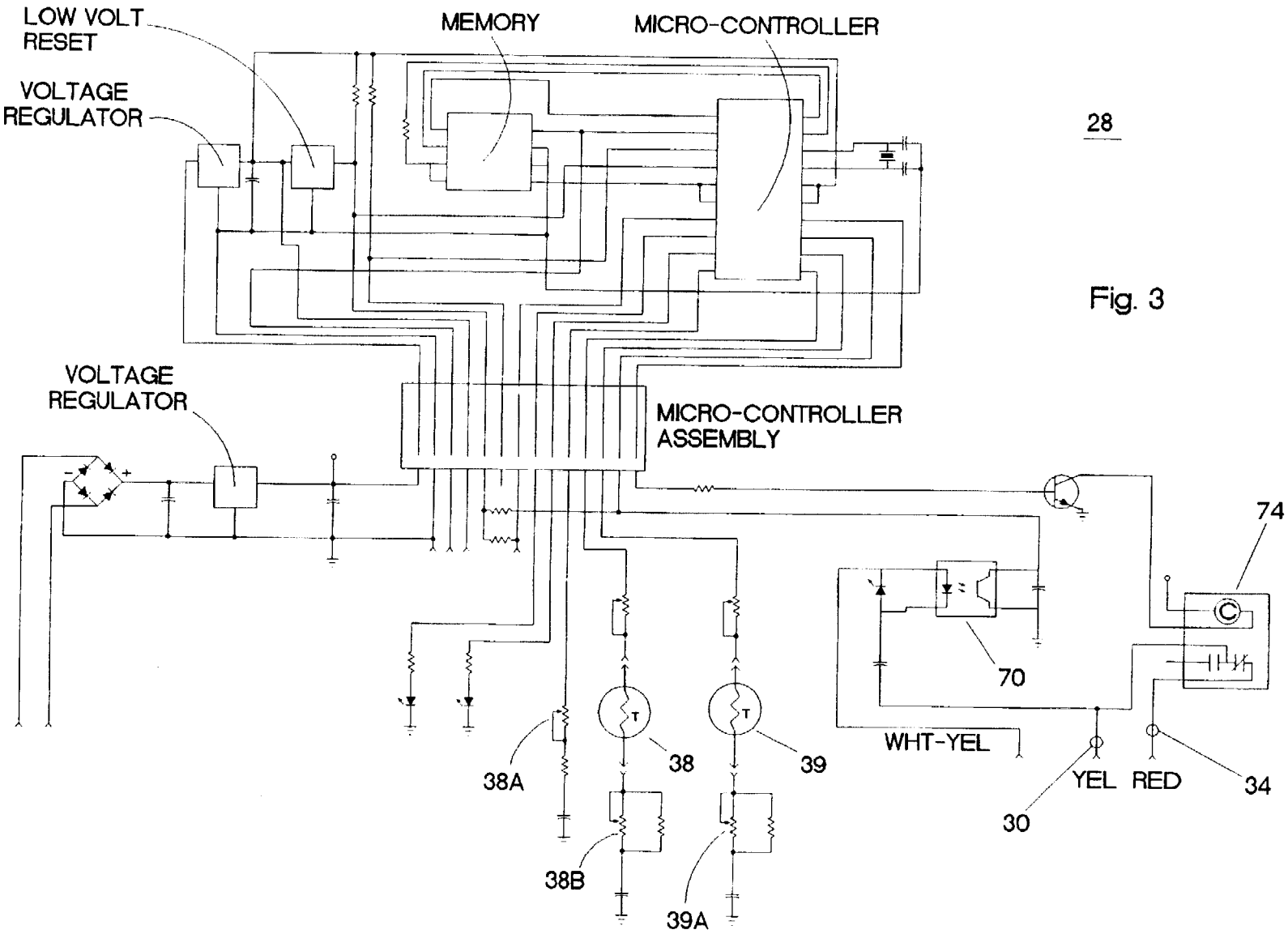
FIG. 3 is a circuit diagram of the control circuit of the invention.

But voltage on hot wire 30 is sensed in FIG. 3 by switch means for actuation by a voltage on the hot wire, which switch means is an electronic circuit capable of a wide range of voltage inputs, preferably optoisolator circuit 70. The wide range of voltage inputs is between 24 VAC and 240 VAC, which copes with any heating system power supply known to the inventor throughout the world.

Circuit 28 monitors outflow temperature 42 and records the outflow temperature at T2 when the optoisolator detects the boiler call. Circuit 28 continues to monitor outflow temperature. When circuit 28 detects a change of a predetermined outflow energy value, ie. a temperature drop 42 (FIG. 4.) between T2 and T3 reflected by a voltage drop across thermistor 38, said change being an energy drop from the outflow energy value at the first time of the firing signal, circuit 28 responds to the change by de-energizing relay 74 to its normally closed condition, and thereby supplying power to fire the burner. Since relay 74 is normally closed, a failure in the invention will result in normal operation of heating system 2.

Because the required change in outflow temperature caused the boiler temperature to fall to 160° F., the burner must remain on longer to reach its upper limit of 180° F. This results in fewer burner cycles 80 (FIG. 4) between T2 and T6. By eliminating the waste of many start-ups, the invention achieves the same room temperature 45 with less burner time 80, with greater efficiency, and with less air pollution.

When the system has been shut off long enough to allow the boiler or hot water coil to reach ambient temperature, the outflow energy value will not drop from the initial value at the burner firing signal. The burner would never fire. Thus, to enable an initial start-up, the invention provides for a lowest limit to the energy outflow sensors, at which lowest limits a boiler thermostat call will result in immediate burner firing.

It can be seen that, by reacting to the outflow energy drop, the invention reacts to the present thermal load on the heating system. The invention adapts itself to load changes immediately. Therefore, it can be said that the invention serves as self adaptive means for reacting to immediate load changes to avoid reaching a boiler energy value low limit.

The microprocessor program follows on the next four pages.

```
'
'
'
'
'
'
'*****************************SYMBOL CONSTANTS/VIABLES*********************
SYMBOL TRUE = 1
SYMBOL FALSE = 0
SYMBOL ON = 0
SYMBOL OFF = 1
SYMBOL FLAG_REG = B0'USES BYTE VARIABLE B0 FOR BIT FLAGS BIT0–7
```

-continued

```
SYMBOL CALIBRATE = PIN0'USES PIN AS INPUT FOR CALIBRATION
SYMBOL CALL4HEAT = PIN6'USES PIN FOR INPUT TO SENSE HEAT CALL
SYMBOL HEATOUT = PIN7'PIN USED FOR OUTPUT RELAY DRIVE
SYMBOL ECONSP = 3'INPUT USED FOR POT INPUT
SYMBOL DOMTEMP = 4'INPUT USED FOR POT INPUT
SYMBOL DOMOLD = B2'TEMP. VALUE USED UP TO CALL4HEAT
SYMBOL DOMVAL = B3
SYMBOL HEATTEMP = 5'INPUT USED FOR POT INPUT
SYMBOL HEATOLD = B4
SYMBOL HEATVAL = B5
SYMBOL HEATSP = 155
SYMBOL LED1 = PIN1
SYMBOL LED2 = PIN2
SYMBOL OVRFLAG = BIT0
SYMBOL COUNT = BIT1
SYMBOL SPCONVFLAG = BIT2
SYMBOL PERCENT = B1
SYMBOL SETPOINT = W3
SYMBOL BYPASSFLAG = BIT3
SYMBOL AVGHEAT = W4
SYMBOL AVGDOM = W5
'*********************************INITIALIZE VARIABLES*********************************
'
DIRS=%10000110'SET 10000110 FOR 2 SENSORS
HEATOUT = OFF
SETPOINT = 0: PERCENT = 0: FLAG_REG = FALSE: BYPASSFLAG = OFF
PAUSE 500
GOSUB MEASURETEMP
HEATOLD = AVGHEAT/10
DOMOLD = AVGDOM/10
IF CALIBRATE = ON THEN BYPASS
'*************************************MAIN ROUTINE*******************************************
MAIN:
IF CALIBRATE = ON THEN CAL'CHECKS FOR SENSOR CALIBRATION REQUEST
MAIN2:
PAUSE 500
IF CALL4HEAT = ON THEN MAINTEST
HEATOUT = OFF
LED1 = TRUE
LED2 = FALSE
SPCONVFLAG = FALSE
GOSUB MEASURETEMP
HEATOLD = AVGHEAT/10
DOMOLD = AVGDOM/10
GOTO MAIN
'*************************************MAIN TEST ROUTINE*******************************
MAINTEST:
GOSUB MEASURETEMP
HEATVAL = AVGHEAT/10
DOMVAL = AVGDOM/10
IF HEATVAL > 190 THEN OVERIDE1
IF DOMVAL > 190 THEN OVERIDE2
MAINTEST2:
IF SPCONVFLAG = FALSE THEN SPCONV
REM DEBUG HEATVAL,HEATOLD,DOMVAL,DOMOLD,SETPOINT
HEATVAL = HEATVAL - SETPOINT
DOMVAL = DOMVAL - SETPOINT
IF HEATVAL > HEATOLD THEN HEATON
IF DOMVAL > DOMOLD THEN HEATON
IF HEATOUT = ON THEN HEATON
TOGGLE 1
GOTO MAIN
'*************************************SETPOINT POT CONVERSION*****************************
SPCONV:
SPCONVFLAG = TRUE
POT ECONSP,185,PERCENT
SETPOINT = PERCENT/15
SETPOINT = SETPOINT MIN 5
SETPOINT = SETPOINT MAX 25
GOTO MAIN
'*******************************TEMPERATURE OVERRIDE ROUTINES**********************
OVERIDE1:
IF BYPASSFLAG = ON THEN MAINTEST2
HEATOUT = ON
LED1 = FALSE
TOGGLE 2'FLASHES LED2
GOTO MAIN
OVERIDE2:
IF BYPASSFLAG = ON THEN MAINTEST2
HEATOUT = ON
```

-continued

```
LED1 = FALSE
REM pulsout 1,100'PULSES LED1 WHEN IN OVERIDE & OVERIDE2 IS ACTIVE
TOGGLE 2'FLASHES LED2
GOTO MAIN
'*************************************TURN HEAT OUTPUT RELAY ON*****************************
HEATON:
HEATOUT = ON
LED1 = FALSE
LED2 = TRUE
GOTO MAIN
'**************************MEASURE TEMP SENSOR SUB ROUTINE**********************
MEASURETEMP:
AVGDOM=0: AVGHEAT=0
FOR B1 = 1 TO 10
POT HEATTEMP, 100, HEATOLD
POT DOMTEMP, 100, DOMOLD
AVGHEAT = AVGHEAT + HEATOLD
AVGDOM = AVGDOM + DOMOLD
NEXT B1
RETURN
'**************************SENSOR CALIBRATION ROUTINE*****************************
CAL:
IF BYPASSFLAG = ON THEN MAIN2
HEATOUT = ON
GOSUB MEASURETEMP
HEATVAL = AVGHEAT/10
DOMVAL = AVGDOM/10
REM POT 5,POTVAL,B1
REM POT 4,POTVAL,B2
REM DEBUG HEATVAL, DOMVAL
IF HEATVAL > 190 THEN LED1N
LED1 = 0
GOTO LED2A
LED1N:
LED1 = 1
LED2A:
IF DOMVAL > 190 THEN LED2N
LED2 = 0
GOTO MAIN
LED2N:
LED2=1
GOTO MAIN
'*********************************OVERIDE BYPASS ROUTINE*****************************
'BYPASSES LOW LIMIT CHECKING - CAN ONLY BE TURNED ON IMMEDIATELY
'AFTER POWER UP WITH CAL JUMPER SET... ... ... ... ... ... ... ... ... ... ....
BYPASS:
BYPASSFLAG = ON
FOR B13 = 1 TO 20
TOGGLE 2
PAUSE 200
NEXT
GOTO MAIN
'
'*****************************END OF PROGRAM*********************************************
```

I claim:

1. A method of improving heating system efficiency, in a heating system having:

a boiler, a burner for heating the boiler, a heat exchanger remote from the boiler for transferring heat to a space to be heated, a fluid heat transfer medium for delivery of heat from the boiler to the heat exchanger, an outflow line communicating the fluid heat transfer medium to said heat exchanger, and an energy value sensor within the boiler for:

sensing a low energy at which the boiler requires more heat, firing said burner at said low energy, sensing a maximum energy, and terminating firing above the maximum energy, said method comprising:

sensing a firing signal from the boiler energy value sensor; and preventing the boiler energy value sensor from firing the burner; while sensing an energy value of the outflow line at the boiler;

monitoring the outflow energy value;

recording the outflow energy value at a first time of the firing signal; then detecting a change of a predetermined outflow energy value, said change being an energy drop from the outflow energy value at the first time of the firing signal; and responding to the change by firing the burner.

2. A method according to claim 1 in which the energy value is a temperature and the energy value sensor is a temperature sensor.

3. A method according to claim 1 in which the energy value is a steam pressure and the energy value sensor is a pressure sensor.

4. In a heating system having:

a boiler, a burner, a heat exchanger, remote from the boiler, for transferring heat to a space to be heated, a fluid heat transfer medium for delivery of heat to the heat exchanger, an outflow line communicating the fluid heat transfer medium to said heat exchanger, and a boiler energy value sensor within the boiler for:

sensing a low energy value at which the boiler requires more heat, firing said burner at said low energy value, sensing a maximum energy value, and terminating firing above the maximum energy value, an improvement comprising:

means for sensing a firing signal from the boiler energy value sensor;

means for preventing the boiler energy value sensor from firing the burner;

means for sensing an energy value of the outflow at the boiler;

means for recording the outflow energy value at a first time of the firing signal;

means for monitoring the outflow energy value;

means for detecting a change of a predetermined outflow energy value, said change being an energy decrease; and means for responding to the change by firing the burner.

5. An apparatus according to claim 4 in which the energy value is a temperature and the outflow energy value sensor means is a temperature sensor.

6. An apparatus according to claim 4 in which the energy value is a steam pressure and the outflow energy value sensor means is a pressure sensor.

7. Apparatus according to claim 4 in which the means for preventing the boiler energy value sensor from firing the boiler comprises:

a break in a power supply wire between:

the boiler energy value sensor, and the burner; and means for switchably bridging said break.

8. Apparatus according to claim 7 in which the means for sensing a firing signal from the boiler energy value sensor comprises:

a hot wire switched on by the boiler energy value sensor in response to the low energy at which the boiler requires more heat; and switch means for actuation by a voltage on the hot wire.

9. Apparatus according to claim 8 in which the switch means for actuation by a voltage on the hot wire is an electronic circuit capable of a wide range of voltage inputs.

10. Apparatus according to claim 9 in which the wide range of voltage inputs is between 24 VAC and 240 VAC.

11. Apparatus according to claim 10 in which the hot wire electronic circuit comprises an optoisolator.

12. Apparatus according to claim 4 in which the means for sensing an energy value of the outflow at the boiler is an energy value sensor means for generating a signal usable by an electronic circuit, and said outflow energy value sensor means is located at the outflow of the boiler.

13. Apparatus according to claim 12 in which the means for recording the outflow energy value at a first time of the firing signal is an electronic circuit which responds to the switch means by recording a voltage at the outflow energy value sensor means;

said electronic circuit also serving as the means for monitoring the outflow energy value by monitoring a changing voltage at the outflow energy value sensor means;

said electronic circuit also serving as the means for detecting the change of the outflow temperature by responding to a predetermined change in the changing voltage at the outflow sensor, corresponding to the change of the outflow temperature, by said electronic circuit actuating the switchably bridging means, thereby providing power to the burner and firing the burner.

14. Apparatus according to claim 13 in which:

the energy value is temperature, and the means for sensing the energy value of the outflow at the boiler is a thermistor mounted at the boiler outflow.

15. Apparatus according to claim 13 in which the electronic circuit comprises a microprocessor.

16. Apparatus according to claim 4 in which the burner cycles on and off when operated at less than maximum load, in which improvement serves as means for reducing a number of burner cycles in a given time period.

17. Apparatus according to claim 16 in which the improvement serves as means for reducing a number of start-ups and thereby serves as means for reducing air pollution.

18. Apparatus according to claim 16 in which the improvement serves as means for increasing burner run time per cycle, thereby resulting in improved fuel utilization.

19. Apparatus according to claim 15 in which the microprocessor is controlled by a program and the program has its own sensor calibration routine.

20. Apparatus according to claim 19 wherein the program and sensor are calibrated to increase sensitivity and decrease the change of the predetermined outflow energy value decrease required to fire the burner at lower boiler energy values.

21. Apparatus according to claim 20 wherein the outflow sensor is a negative energy value coefficient thermistor, said thermistor having an inherent non-linearity, with greater voltage drops at lower temperatures, which non-linearity serves as means for the program to respond linearly to thermistor voltage while having non-linear and increased sensitivity to smaller temperature decreases at lower temperatures.

22. Apparatus according to claim 4 having means for immediately actuating the burner when the boiler energy value approaches ambient temperature, by sensing a lowest limit to the energy outflow sensor, at which lowest limit a boiler thermostat call will cause the control circuit to immediately fire the burner.

23. Apparatus according to claim 4 wherein the program comprises self adaptive means for reacting to present thermal load changes to avoid reaching the boiler low energy value.

24. Apparatus according to claim 21 having:

means for immediately actuating the burner when the boiler energy value approaches ambient temperature, by sensing a lowest limit to the energy outflow sensor, at which lowest limit a boiler thermostat call will cause the control circuit to immediately fire the burner; and wherein the apparatus serves as self adaptive means for reacting to present thermal load changes to avoid reaching the boiler low energy value.

* * * * *